United States Patent [19]

Shoemaker, Jr. et al.

[11] 4,303,248

[45] Dec. 1, 1981

[54] MANUALLY DIRECTED COIN GAME

[76] Inventors: Stephen P. Shoemaker, Jr., 123 S. Harbor Dr., Redondo Beach, Calif. 90277; Foster M. Brashear, 2402 Grand Canal, Venice, Calif. 90291

[21] Appl. No.: 965,876

[22] Filed: Dec. 4, 1978

[51] Int. Cl.[3] ..... A63F 7/02

[52] U.S. Cl. ..... 273/356; 273/357; 273/371; 194/DIG. 11

[58] Field of Search ..... 194/DIG. 11, 1 K; 273/101, 354, 355, 356, 357, 351

[56] References Cited

U.S. PATENT DOCUMENTS

| | | | |
|---|---|---|---|
| 1,484,752 | 2/1924 | Apperson et al. | 273/351 |
| 2,006,955 | 7/1935 | Kolar | 273/101 |
| 3,734,502 | 5/1973 | Bolton | 273/400 |
| 4,061,334 | 12/1977 | Kanno | 273/127 E |
| 4,095,795 | 6/1978 | Saxton et al. | 273/143 R |
| 4,101,129 | 7/1978 | Cox | 273/138 A |
| 4,126,309 | 11/1978 | Hicks et al. | 273/351 X |
| 4,240,536 | 12/1980 | Noell, Jr. | 194/1 K |

FOREIGN PATENT DOCUMENTS

| | | | |
|---|---|---|---|
| 399349 | 10/1933 | United Kingdom | 273/126 R |
| 1131596 | 10/1968 | United Kingdom | 194/DIG. 11 |

*Primary Examiner*—Anton O. Oechsle

*Attorney, Agent, or Firm*—Bruno J. Verbeck; Michael L. Slonecker

[57] ABSTRACT

Disclosed herein is an amusement game wherein coins are dropped onto a flat surface over which a vertical dam is horizontally translated. The vertical dam translates over a portion of the flat surface and will thus drop certain of the accumulated coins over the edge. The coins, as they drop over the edge, are collected in a counting chute to be synchronously counted in a memory which is then synchronously unloaded to vend out a corresponding number of tokens.

3 Claims, 3 Drawing Figures

MANUALLY DIRECTED COIN GAME

BACKGROUND OF THE INVENTION

1. Field of the Invention

The present invention relates to gaming devices and more particularly to coin pitching devices of the mechanical kind.

2. Description of the Prior Art

In many amusement parks the engagement in various pitching games provides entertainment to the public. Since many states prohibit gambling the pay off cannot be related to random chance but must predominantly rely on skill. For this reason any game providing a payoff in an amusement center will necessarily include a relatively high correspondence between the number of coins played and the pay off count.

The present invention is directed to provide a game of this kind wherein the attributes of skill are combined with mechanically repeatable features to return a payoff to the player.

SUMMARY OF THE INVENTION

Accordingly, it is the general purpose and object of the present invention to provide a game device wherein coins are mechanically pitched to advantageous locations.

Other objects of the invention are to provide a coin dropping game device which is substantially insensitive to external forces applied by the user.

Yet additional objects of the invention are to provide a game device wherein coins are periodically dropped in an asynchronous manner to enable a synchronous dispensement of paid off tokens.

Briefly these and other objects are accomplished within the present invention by providing a rectangular housing having a translucent top surface, the housing being attached to ground around the bottom edges thereof. Included in the housing are two inwardly directed, articulated, coin chutes by which coins of certain denomination may be aimed to be dropped onto an inner surface formed on the top of an interior housing. This coin surface includes a vertical dam extending thereacross the dam being translated by a motor to sweep back and forth across the top surface, covering a portion thereof. Thus as a sufficient number of coins is accumulated on the interior surface certain numbers thereof will be pushed by the dam over the edge. The coins, as they are pushed over the edge are then trapped by a counting chute which is provided with a photoelectric detector to count down a preset counter in an asynchronous manner. Once the counter is counted down by the number of coins pushed over the edge a synchronous count up is enabled which concurrently pulses dispensing relay to dispense a corresponding count of payout tokens.

By virtue of this structure only an electrical connection is necessary between the inner and the outer housing, the connection enabling the payout of tokens. Thus the inner housing can not be disturbed by the player assuring for a reliable game and thus promoting enjoyment.

DESCRIPTION OF THE SPECIFIC EMBODIMENTS

Figure 2:
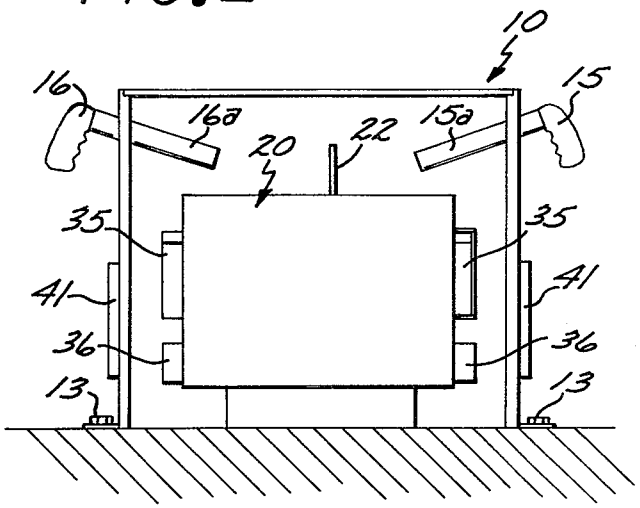
FIG. 2 is a side view in section taken along line 2—2 of FIG. 1.
Figure 1:
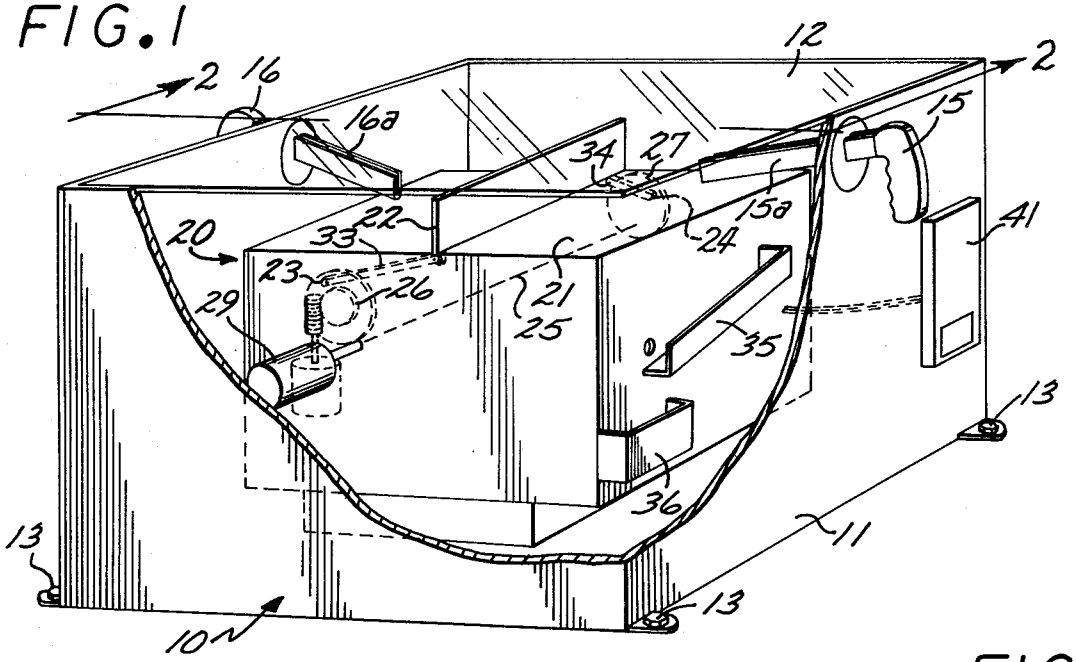
FIG. 1 is a diagrammatic illustration of a gaming device constructed according to the present invention.

As shown in FIG. 1 and 2 the gaming device, generally designated by the numeral 10, comprises an exterior housing 11 of substantially rectangular shape, housing 11 having a translucent upper surface 12 through which viewing can be made into the interior thereof. In this form, housing 11 provides the requisite side wall structure to resist exterior impacts, the side walls being attached to ground by a plurality of ground attachment fixtures 13. Formed in the side walls proximate two opposed edges of the translucent opening or surface 12 are two universally gimballed coin chutes 15 and 16 respectively, each extending through the side wall to deploy the end thereof over an interior rectangular housing 20. Housing 20, once more, is directly supported on ground, and therefore is isolated structurally from housing 11. Thus the only impacts possible are those of the coins as they are dropped through the articulated chutes 15 and 16 onto the interior housing.

More specifically, coin chutes 15 and 16 include interior ends 15*a* and 16*a* shaped in a manner of a narrow U and aligned substantially in a vertical plane. The trough formed by each one of these U-shaped structures is then manually articulated by the player to control the speed of the coin rolling therethrough and its final trajectory.

In this manner the angle and speed of the coin trajectory can be controlled, determining the eventual impact thereof onto housing 20. It is intended to limit the degree of articulation of chutes 15 and 16 to insure that the coin trajectories in each instance intersect the top surface thereof, shown herein as a smooth horizontal top surface 21. This smooth top surface 21 is swept by a horizontally translated dam 22 aligned vertically on edge and translated by any conventional articulating means, the means selected herein comprising two cranks 23 and 24 mounted for rotation at the edges of the inner housing 20 and each geared to a common shaft 25 by way of corresponding gears 26 and 27. Shaft 25, in turn, may be driven continuously by an electric motor 29 thus continually rotating the associated cranks. Each crank 23 and 24 is in turn connected to a corresponding push rod 33 and 34 which extends to engage the vertical dam 22. The dimensions of the crank throw in each instance are selected to limit the extent of translating motion of the dam such that the dam 22 covers less than the full area of the top surface 21. Accordingly as the course of play progresses sufficient number of coins are accummulated on the upswept edges of surface 21 to a point where each additional coin when laid flat in the swept area will result in an avalanche of one or more coins lying on the edge. These coins, as they are dropped over the edge, fall into a downwardly inclined counting trough 35 formed on the lateral surfaces of housing 20. When dropped into these troughs the coins will progress across a viewing aperture wherein any photoelectric device may be installed. This viewing aperture may then be utilized to trigger a counting circuit, to be described, which provides a pay off count on a lead 40 to a pay off gate assembly 41 supported on the exterior of housing 11. It is in this pay-off gate 41 that a plurality of tokens may be stored which the player may collect in order to reclaim or to purchase any award desired. It is to be understood that the coins as they translate in chute 35 do not return to the user, in each instance the coin chute 35 terminating over a collection box 36 which may be periodically collected by the owner of the game.

As shown in FIGS. 1 and 2, coin chutes 15 and 16 are deployed through the sidewalls of housing 11 proximate to the edges of housing 20 over which the coins will fall. This results in the positioning of said chutes such that each of them are free to articulate within a predetermined pivotal range to either side of the axis which passes through their respective gimbals and intersects dam 22 at a substantially right angle.

In this manner a gaming device is formed wherein the user has substantial control over the trajectory of the coins as they are dropped through chutes 15 and 16 and to a certain extent over the eventual placement of the coin on surface 21. By appropriate use of skills, it is thus possible to drop coins onto the swept area of the top surface which will then force the coins collected on the unswept area to drop over the edge.

Figure 3:
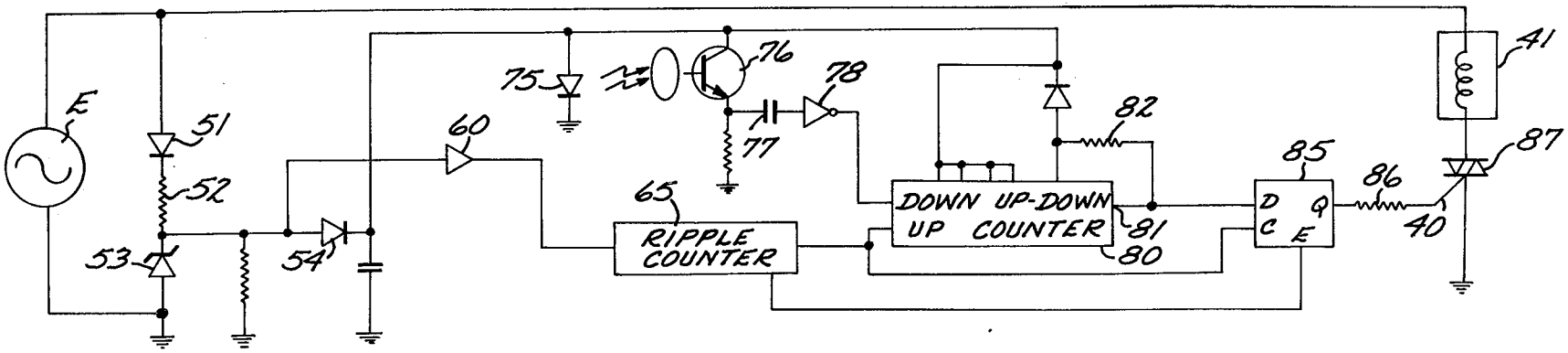
FIG. 3 is a circuit diagram illustrating the implementation of the up and down counting logic constructed according to the present invention.

The counting of the coins as they are dropped over the edge and the eventual dispensing of the payoff tokens is achieved by way of the circuit shown in FIG. 3. More specifically, as shown in this figure, an external source of sixty-cycle power shown as source E is connected across a rectifying diode 51 in series with a resistor 52 to the cathode of a zener diode 53. This circuit, at the cathode of the zener diode, will thus produce a zener clipped wave form which is fed both to the anode of an isolation diode 54 filtered at the cathode by a filtering capacitor 55 to produce a DC power supply and to the input of a Schmitt trigger or gate 60 which sharpens the transition time of the sixty cycle ripple left after clipping and also inverts and shapes this signal to produce a sixty-cycle pulse train. This pulse train is fed to a ripple counter 65 used as a frequency divider. At the same time the DC power supply developed at capacitor 55 is connected to the anode of a light-emitting diode 75 coupled across the coin chute 35 to a phototransistor 76. As the coins descend down the chute the phototransmission of diode 75 is interrupted, switching off the transistor. Transistor 76 is arranged in a conventional emitter follower configuration, being connected by a differentiating capacitor 77 to the input of yet another Schmitt trigger 78. As the coin passes, the positive transient is passed through capacitor 77 to the input of the trigger or the gate 78 which inverts this transition and shapes a pulse to an up-down counter 80. Counter 80 is clocked up by a first division output of the ripple counter 65 and will count up until all of the count bits are high. When a full count of counter 80 is reached the terminal count bit shown herein by connection 81 is returned across a resistor 82 to allow a parallel load input instructing the counter to load the parallel inputs which are all pulled high by the connection thereof to the positive DC supply voltage. Thus the up-down counter is continuously reloaded with its maximum count by the parallel side loading enabled by the terminal count at each output of the frequency divider 65. This prevents the counter from clocking through to state 0, continuously maintaining the counter at its maximum count. It is to be understood that the output of the divider 65 is connected to the up count terminal, the down count terminal being connected to the output of the Schmitt trigger 78. Thus upon any occurrence of a coin count pulse as the output of the schmidt trigger an asynchronous down count is enabled, disabling the terminal count which reduces the count in the counter by the number of points passed. This reduction in the count corresponds to the number of coin pulses and will therefore supress the terminal count at terminal 81 for the number of pulse cycles produced at divider 65. Thus divider 65 may be connected to the clock terminal of a flip flop 85 while the terminal 81 is connected to enable the flip flop. At the same time a higher division frequency terminal of divider 65 may be connected to the reset terminal of the flip flop 85, resetting this flip flop after each of its clocking cycles and within the clocking aperture. Thus the flip flop will produce at one output thereof a series of AC reference pulses separated by the division increment of divider 65 which may then across a resistor 86 gate, across the lead 40, a Triac 87 connected in circuit with the token dispenser mechanism 41. The token dispenser mechanism, in manners known conventionally, may then dispense in synchronous form corresponding number of tokens to satisfy the number of coins dropped.

It should be noted that the foregoing system fully separates the structure and operation of the internal housing 20 from the external dispenser 41. Thus, any coins dropped into the interior of housing 11, once on surface 21, cannot be manipulated by the player other than by the insertion and dropping of additional coins.

Obviously many modifications and changes may be made to the foregoing description without departing from the spirit of the invention. It is therefore intended that the scope of the invention be determined solely on the claims appended hereto.

What is claimed is:

1. A token dispensing game device, comprising:

(a) a first housing supported upon ground and having a top surface aligned in a substantially horizontal plane;

(b) a second housing wholly enclosing said first housing and being secured to ground separately therefrom, a surface portion of said second housing being transluscent whereby said top surface of said first housing is viewable therethrough;

(c) a dam disposed upon said first housing and deployed to slidably translate over a portion of said top surface;

(d) coin dispensing means extending through a lateral surface of said second housing for directing the passage of coins onto said top surface;

(e) coin receiving means for collecting such coins as are pushed over an edge of said top surface by said dam and for producing sensing signals indicative thereof; and (f) token dispensing means connected to receive said sensing signals for dispensing a number of tokens corresponding to the number of coins sensed.

2. A device as set forth in claim 1 wherein said dam further includes means for reciprocally sliding said dam over said portion of said top surface.

3. A device as set forth in claim 1 further comprising means connecting said coin dispensing means and said second housing for free relative pivotal movement of said coin dispensing means within a predetermined pivotal range.

* * * * *